US005166736A

United States Patent [19]

Ogawa et al.

[11] Patent Number: 5,166,736

[45] Date of Patent: Nov. 24, 1992

[54] ELECTROPHOTOGRAPHIC PRINTING APPARATUS WITH PIVOTABLE PAPER BUFFER AND PIVOTABLE GUIDE MEMBER

[75] Inventors: Toshitaka Ogawa; Yasuo Kikuchi; Junzi Shirakawa, all of Ibaraki, Japan

[73] Assignee: Hitachi Koki Co., Ltd., Tokyo, Japan

[21] Appl. No.: 655,714

[22] Filed: Feb. 15, 1991

[30] Foreign Application Priority Data

Feb. 16, 1990 [JP] Japan ..... 2-36897

[51] Int. Cl.[5] ..... G03G 15/00

[52] U.S. Cl. ..... 355/308; 226/199; 355/321

[58] Field of Search ..... 355/308, 321; 226/74, 226/196, 199; 271/3

[56] References Cited

U.S. PATENT DOCUMENTS 4,110,027 8/1978 Sato et al. ..... 355/309 X 4,131,358 12/1978 Windele ..... 226/196 X 4,475,677 10/1984 Rutishauser ..... 226/74

4,876,576 10/1989 Itaya et al. ..... 355/311 X

*Primary Examiner*—A. T. Grimley

*Assistant Examiner*—Nestor R. Ramirez

*Attorney, Agent, or Firm*—Cushman, Darby & Cushman

[57] ABSTRACT

An electrophotographic printing apparatus with a pivotable paper buffer and a pivotable guide member which together, depending on their position in relation to each other, form either a loading configuration or a printing configuration. In the loading configuration, the pivoting end of the buffer is adjacent to the pivoting end of the pivotable guide member to form a horizontal path for the paper to travel between the photosensitive member and the fixing portion. In the printing configuration, the buffer pivots upward away from the guide member so that it is in a position to receive a paper sheet as it is fed by a tractor after being contacted by the photosensitive member.

7 Claims, 1 Drawing Sheet

ELECTROPHOTOGRAPHIC PRINTING APPARATUS WITH PIVOTABLE PAPER BUFFER AND PIVOTABLE GUIDE MEMBER

BACKGROUND OF THE INVENTION

1. Field of Invention

This invention relates to an electrophotographic apparatus in which paper is automatically loaded and is printed.

2. Description of Related Art

FIG. 3 (PRIOR ART) is a view of a conventional electrophotographic apparatus, showing a paper travel path. Tractors 2A and 2B feed a paper sheet 1. A guide member 3 comprises an endless belt and feeds the paper sheet 1 while holding it by suction. A support shaft 4 serves as a pivot for a guide member 3. A fixing portion 5 fixes an image on paper 1. A pulling member 6 pulls the paper sheet 1 so as to prevent the same from being slackened. Stackers 7A and 7B accommodate the paper sheet. A photosensitive drum 8 is provided along the paper path between tractors 2A and 2B for imparting an image to the paper.

When this apparatus is used, two operations, that is, (A) the automatic loading of the paper sheet and (B) the printing, are carried out.

(A) Automatic Loading of Paper Sheet

The paper sheet 1 is set on the tractor 2A, and when an automatic loading device (not shown) is operated, the paper sheet 1 is caused to move as the tractor 2A rotates. At this time, before the leading edge of the paper sheet 1 reaches the tractor 2B, the guide member 3 is pivoted on the support shaft 4 from the position indicated by broken lines in the direction of the arrow (in FIG. 3) to thereby interconnect the tractor 2B and the fixing portion 5. The paper sheet 1 is sucked by the guide member 3, passes past the fixing portion 5, and is pulled by the pulling member 6 to the stacker 7B where it is stored.

(B) Printing

The paper sheet 1 is fed by the tractor 2A to the photosensitive member 8 where it is photo-sensitized, exposed, developed and carried away past the tractor 2B to the fixing portion 5. At this time, the guide member 3 pivots back to the position indicated by the broken line, and the paper sheet 1, having been subjected to the fixing portion 5, moves past the pulling member 6, and is stored in the stacker 7B.

As described above, in order to feed the paper sheet to the fixing portion, after it has been loaded and carried past the photosensitive member 8, the guide member 3 is needed. The guide member 3 requires associated devices, such as a suction device for suctioning the paper sheet, a drive device for producing a rotational motion, and a cooling device. As a result, conventionally, the guide member 3 tends to be of substantial size and length. The necessity for such size and length has posed operational problems.

Such problems are, for example, cumbersome handling, the necessity of having a large power source capacity which results in higher cost, and the jamming of the paper sheet resulting from a poor fit between the front and rear ends of the guide member and their respective mating parts. Thus, the above problems need to be alleviated.

SUMMARY OF THE INVENTION

It is an object of this invention to provide an electrophotographic apparatus which is very reliable.

The present invention provides an electrophotographic apparatus wherein printing on a paper sheet is effected by transferring an image onto the loaded paper sheet which has been fed from a stacker to move past a tractor to a photosensitive member and then past another tractor to a paper buffer and a guide member, after which the paper sheet is fed to a fixing portion.

The paper buffer can pivot between a configuration for loading the paper sheet and a configuration for printing the paper sheet. A paper buffer drive portion switches the position of the paper buffer between the loading configuration and the printing configuration.

The paper buffer pivots on a support shaft which is attached to one end of the paper buffer but allows the other end to move back and forth on the support shaft. The attached end of the paper buffer is positioned at the outlet side of the tractor.

The pivoting end of the paper buffer can be moved close to the guide member at the time of loading the paper sheet, and can be moved away from the guide member at the time of printing the paper sheet. The guide member, like the paper buffer, is attached at one end and pivotable at the other. The attached end is positioned at the inlet side of the fixing portion, while the pivoting end can be positioned adjacent to the pivoting end of the paper buffer at the time of loading the paper sheet so as to form a continuous horizontal path on which the paper sheet travels.

During the process of loading the paper sheet, the guide member is positioned so that its pivoting end is at a position slightly lower than the pivoting end of the paper buffer. At all other times, the pivoting end of the guide member is positioned away from the path of travel of the paper sheet.

An interconnecting member is provided between the paper buffer and the guide member to connect them.

The guide member has a position sensor for sensing the position of the pivoting end of the guide member.

The guide member is located in the forward direction from the paper buffer in terms of the direction that the paper sheet travels in the process of printing and loading.

During the loading of the paper sheet, the pivoting end of the guide member and the pivoting end of the paper buffer are horizontally interconnected opposite each other, to ensure that the paper sheet travels stably, even when the length of the guide member is short.

During printing, the pivoting end of the guide member is rotated downward, while at the same time, the pivoting end of the paper buffer is moved upward to provide a smooth surface for the paper sheet to slide across as the rest of the paper sheet is printed and also to prevent the paper sheet from becoming slackened during printing. By this means, the paper sheet travels stably. Since the position of movement can be detected by the position sensor mounted on the guide member, the reliability of the printing and loading operations is further improved.

BRIEF DESCRIPTION OF THE DRAWINGS

Preferred embodiment(s) of the invention will be described in detail with reference to the drawings wherein like reference numerals denote like or corresponding parts throughout.

DETAILED DESCRIPTION OF THE PREFERRED EMBODIMENTS

Figure 1:
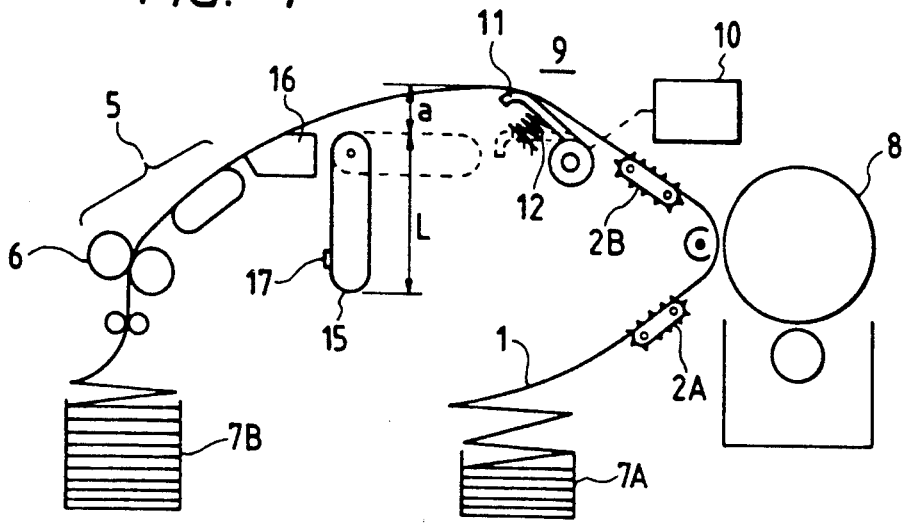
FIG. 1 is a view of one preferred embodiment of an electrophotographic apparatus, showing a paper travel path.
Figure 2:
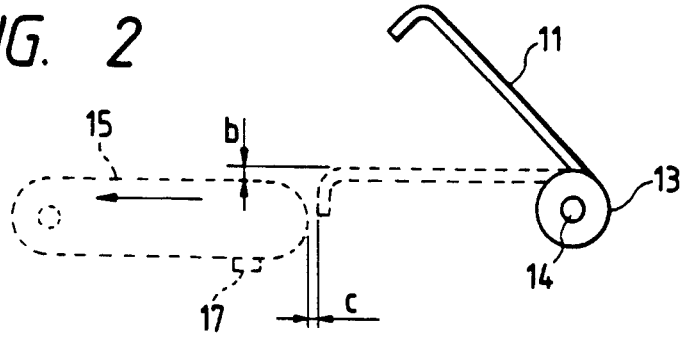
FIG. 2 is a view illustrative of the operations of a paper buffer and a guide member of FIG. 1.
Figure 3:
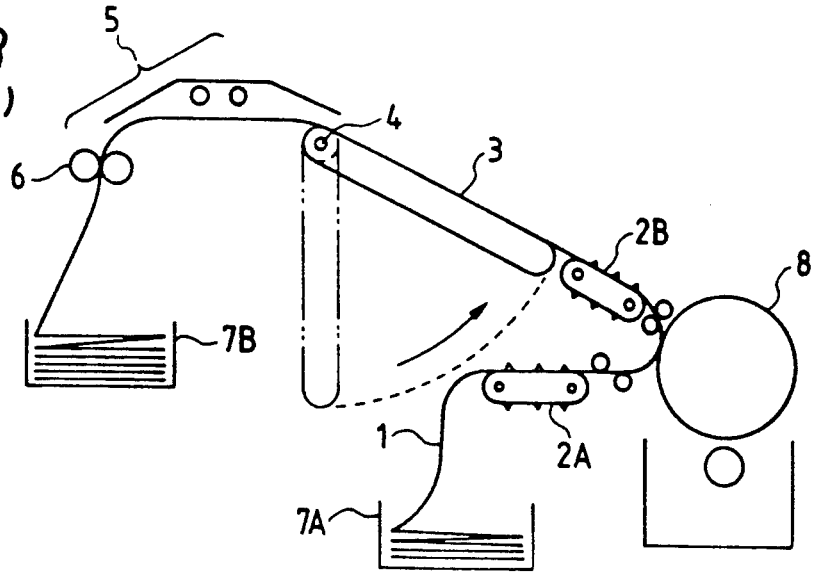
FIG. 3 (PRIOR ART)
FIG. 3 (PRIOR ART) is a view of a conventional electrophotographic apparatus, showing a paper travel path.

A preferred embodiment of the present invention will now be described with reference to the drawings. FIG. 1 is a view of one preferred embodiment of an electrophotographic apparatus of the present invention, showing a paper travel path, and FIG. 2 is a view illustrative of the operations of a paper buffer and a guide member shown in FIG. 1. Those parts identical to those of FIG. 3 are denoted by identical reference numerals, respectively. Referring to FIGS. 1 and 2, the apparatus comprises the paper buffer 9, a paper buffer drive portion 10 for switching the operation of the paper buffer 9 in accordance with either loading or printing, a buffer 11, a cushioning spring 12 for the buffer 11, a rotation member 13 for pivoting the buffer 11, a support shaft 14, the guide member 15, a suction member 16, and a position sensor 17.

(A) Operation for Loading Paper Sheet

The paper sheet 1 is set on a tractor 2A, which moves the paper sheet 1 to the photosensitive member 8. The apparatus is switched into an automatic loading mode, after the paper sheet 1 has been transferred from the photosensitive member 8 to the paper buffer by the tractor 2B. At this time, the paper buffer drive portion 10 operates to bring down the paper buffer 9 into a horizontal position indicated by the dotted-line figure in FIG. 2. At the same time, the guide member 15 is pivoted into a horizontal position adjacent to the buffer 11, as shown by the dotted-line figure in FIG. 2. At this time, dimensions b and c, shown in FIG. 2, are 1 to 2 mm and 3 to 4 mm, respectively. Thus, the height of the guide member 15 is slightly lower than the height of the paper buffer 9 to facilitate the advancing of the paper sheet 1. The paper sheet 1 is moved by a belt (which may be made of rubber or other similar material) on the guide member 15, and is smoothly driven past a fixing portion 5 and a pulling member 6, and is stored in the stacker 7B.

(B) Operation for Printing

When the above operations are finished, the suction member 16 is operated to hold the paper sheet 1 by suction. Then, the guide member 15 is rotated and returned to its original position indicated by a solid line in FIG. 1, and the paper buffer 9 is also returned to its original position in response to an instruction from the paper buffer drive portion 10, and the buffer 11 is moved upward under the influence of the cushioning spring 12, as indicated by a solid line in FIG. 2. Then, a predetermined length of the paper sheet 1 is fed by the tractor 2B. At this time, the vertical distance between the loading portion of the buffer 11 and the horizontally disposed guide member 15 is a as shown in FIG. 1. When the position sensor 17 detects an abnormal movement, such as an unstable movement of the guide member 15 from its upper to lower position, the position sensor 17 operates to stop the movement of the paper buffer 9.

The feeding of the paper sheet is carried out in the above-described manner. The paper sheet slides on the paper buffer 9 and the fixing portion 5 rather than being moved by a belt and therefore sliding frictions develop. Such sliding frictions are greater than the rolling frictions developing at the tractor 2A and 2B and the guide member 15 (all of which operate by moving belts), and therefore the paper sheet is liable to be jammed at those portions where such sliding frictions occur. In this embodiment, however, the guide member 15 is positioned next to the paper buffer 9 in order to avoid the concentration of these frictions, and therefore the paper sheet can be smoothly fed.

In the above embodiment, although the paper buffer and the guide member are driven by separate drive systems, respectively, an interconnecting member can be provided so that the paper buffer and the guide member can be driven by the same drive system in an associated manner.

As described above, the present invention achieves the following advantages:

(1) The paper sheet can be smoothly fed, thereby greatly improving the reliability of the apparatus.

(2) Since the dimension L of the guide member can be reduced, the guide member body can be reduced in overall size.

(3) The belt of the guide member is not required to have a paper suction mechanism, and therefore the guide member can be simplified and lightweight.

While this invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. An electrophotographic printing apparatus comprising:

means for supplying paper to said printing apparatus;

means for transferring an electrophotographic image onto a supplied paper sheet;

means for fixing a transferred image onto said paper sheet;

a first tractor located adjacent to said transferring means and extending toward said fixing means for carrying paper affixed with an image away from said transferring means;

a buffer pivoted at a point adjacent to said first tractor and which can pivot toward and away from said fixing means for providing a receiving surface for said paper sheet to slide across and prevent slackening of said paper sheet as said paper sheet moves away from said first tractor toward said fixing means; and a guiding member pivoted at a point adjacent to said fixing means and which can pivot toward and away from said buffer, wherein said guiding member together with said buffer provides a flat surface wherein said paper sheet travels between said receiving surface of said buffer and said fixing means.

2. An electrophotographic printing apparatus according to claim 1, wherein said buffer comprises means for pivoting in response to an electrical signal.

3. An electrophotographic printing apparatus according to claim 1, wherein said guiding member comprises a sensing device located on a pivoting end of said guiding member for detecting the position of said guiding member in relation to said buffer.

4. An electrophotographic printing apparatus according to claim 1, wherein said supplying means comprises:

a stacker for storing a plurality of said paper sheets before said paper sheets are affixed with an image; and a second tractor located between said stacker and said transferring means for carrying paper to said transferring means.

5. An electrophotographic printing apparatus comprising:

means for supplying paper to said printing apparatus;

means for transferring an electrophotographic image onto a supplied paper sheet;

means for fixing a transferred image onto said paper sheet;

a first tractor located adjacent to said transferring means and extending toward said fixing means for carrying paper affixed with an image away from said transferring means;

a buffer pivoted at a point adjacent to said first tractor and which can pivot toward and away from said fixing means for providing a receiving surface for said paper sheet to slide across and prevent slackening of said paper sheet as said paper sheet moves away from said first tractor toward said fixing means; and a guiding member pivoted at a point adjacent to said fixing means and which can pivot toward and away from said buffer, for carrying said paper sheet away from said buffer to said fixing means, wherein said buffer and said guiding member can be positioned to form a loading configuration and a printing configuration, wherein, at said loading configuration, a pivoting end of said buffer is adjacent to a pivoting end of said guiding member, and at said printing configuration, a pivoting end of said buffer is positioned away from a pivoting end of said guiding member.

6. An electrophotographic printing apparatus according to claim 5, wherein, at said loading configuration, said buffer and said guiding member form a continuous horizontal surface with said pivoting end of said guide member adjacent to and slightly lower than said pivoting end of said buffer.

7. An electrophotographic printing apparatus according to claim 6, wherein at said loading configuration, said apparatus comprises an interconnecting member between said pivoting end of said buffer and said pivoting end of said guiding member.

* * * * *